United States Patent [19]

Gabrielsen et al.

[11] 3,985,565

[45] Oct. 12, 1976

[54] PHOTOTHERMOGRAPHIC, COMPOSITION USING A PHENOLIC LEUCO DYE AS A REDUCING AGENT

[75] Inventors: Rolf S. Gabrielsen, Rochester, N.Y.; Felice M. Cerquone, Aurora, Colo.

[73] Assignee: Eastman Kodak Company, Rochester, N.Y.

[22] Filed: July 12, 1974

[21] Appl. No.: 488,094

[52] U.S. Cl. ..... 96/114.1; 96/29 R; 96/77; 96/100

[51] Int. Cl.[2] ..... G03C 1/02; G03C 1/40; G03C 5/04

[58] Field of Search ..... 96/114.1, 48 HD, 114.6, 96/100; 260/309

[56] References Cited

UNITED STATES PATENTS

| | | | |
|---|---|---|---|
| 2,324,832 | 7/1943 | Frölich et al. | 96/100 |
| 2,772,163 | 11/1956 | Tong | 96/97 |
| 3,761,270 | 9/1973 | de Mauriac et al. | 96/77 |
| 3,816,132 | 6/1974 | Takegawa et al. | 96/48 HD |

OTHER PUBLICATIONS

Color: Theory and Imaging Systems, Society of Photographic Scientists and Engineers, 1973, pp. 216–217.

*Primary Examiner*—David Klein
*Assistant Examiner*—Louis Falasco
*Attorney, Agent, or Firm*—Richard E. Knapp

[57] ABSTRACT

In a photothermographic element, composition or process for producing developed images employing processing with heat, a combination comprising (a) photographic silver halide in association with (b) a silver salt of a long-chain fatty acid and (c) a phenolic leuco dye reducing agent for the silver salt of a long-chain fatty acid provides an image in color. After imagewise exposure of the photothermographic element or composition, a color image can be obtained by heating the photothermographic element or composition containing this combination. This combination can be in a diffusion transfer, photothermographic element.

12 Claims, No Drawings

PHOTOTHERMOGRAPHIC, COMPOSITION USING A PHENOLIC LEUCO DYE AS A REDUCING AGENT

BACKGROUND OF THE INVENTION

1. Field of the Invention

This invention relates to photothermographic elements, compositions and processes for providing a developed image in color. One of its aspects relates to photothermographic elements for providing such a developed image in color comprising photographic silver halide in association with a silver salt of a long-chain fatty acid and certain reducing agents which are oxidizable imagewise to provide the color image. In another of its aspects, it relates to photosensitive compositions for providing such a developed image in color containing the described components. A further aspect relates to a process of obtaining an image in color in an exposed photothermographic element containing the described components by uniformly heating the element.

2. Description of the State of the Art

It is well known to develop a latent image in a photothermographic element using processing with heat. After imagewise exposure, the resulting latent image in the photothermographic element is developed and, in some cases, stabilized, merely by uniformly heating the photothermographic element. Such materials and process are described, for example, in U.S. Pat. No. 3,152,904 of Sorensen et al., issued Oct. 13, 1964; U.S. Pat. No. 3,301,678 of Humphlett et al., issued Jan. 31, 1967; U.S. Pat. No. 3,392,020 of Yutzy et al., issued July 9, 1968; U.S. Pat. No. 3,457,075 of Morgan et al., issued July 22, 1969; British Patent No. 1,131,108 published Oct. 23, 1968; German Patent No. 888,045 issued June 29, 1943 and British Patent No. 1,161,777 published Aug. 20, 1969.

Certain photothermographic materials for producing a developed image in color are also known as described, for example, in U.S. Pat. No. 3,531,286 of Renfrew, issued Sept. 29, 1970 and U.S. Pat. No. 3,761,270 of deMauriac and Landholm, issued Sept. 25, 1973. The reducing agent employed in the materials of U.S. Pat. No. 3,531,286 of Renfrew employ paraphenylenediamine which can be unsuitably toxic. When the paraphenylenediamine is replaced with a less toxic reducing agent, such as an aminophenol, no suitable color image is developed. In the photothermographic materials of deMauriac and Landholm, a base-release agent is needed to provide the necessary color-forming reaction in the photothermographic material. In addition, a color-forming coupler is required in the described photothermographic materials. No suitable solution to elimination of these problems is evident from the described patents.

Thermographic materials are also known for providing an image in color. However, the image is provided by imagewise heating. Such thermographic materials are described, for example, in U.S. Pat. No. 3,094,417 of Workman, issued June 18, 1963 and U.S. Pat. No. 3,592,650 of De Selms, issued July 13, 1971. There are not useful for photographic processes requiring the photographic speed of photosensitive silver halide in which a latent image is provided by imagewise exposure to light.

Accordingly, there has been a continuing need for improved photothermographic materials for providing a developed image in color which also provide desired photosensitivity, eliminate the need for a separate color-forming coupler and can provide different colors such as cyan, magenta and yellow.

SUMMARY OF THE INVENTION

It has been found according to this invention that, by means of thermal processing, a developed image in color, which avoids the described problems, can be provided by a photothermographic element and composition comprising a combination of (a) photographic silver halide in association with (b) a silver salt of a long-chain fatty acid and (c) a phenolic leuco dye reducing agent for said silver salt of a long-chain fatty acid, and (d) a synthetic polymeric binder for the combination, wherein the dye reducing agent is oxidizable imagewise. It is a significant feature of the invention, as illustrated in the following examples, that the phenolic leuco dye reducing agent can be employed in place of other reducing agents or in combination with other reducing agents in the described photothermographic materials. In the absence of the phenolic leuco dye reducing agent, no desired color image is developed upon heating the combination of components.

The described combination of components with the phenolic leuco dye reducing agent can be employed in a diffusion transfer photothermographic material comprising a support having coated thereon (I) a layer comprising: (a) photographic silver halide in association with (b) a silver salt of a long-chain fatty acid, (c) a phenolic leuco dye reducing agent for the silver salt of a long-chain fatty acid, and (d) a synthetic polymeric binder, and (II) an image receiving layer which is capable of receiving a dye from the described layer (I). This diffusion transfer photothermographic material can be an integral diffusion transfer photothermographic element having an opacifying interlayer between the layer comprising the photographic silver halide and an image receiving layer. This avoids the need for a separate image receiving element if the image receiving layer is visible, such as when it is on a transparent support.

DETAILED DESCRIPTION OF THE INVENTION

A variety of phenolic leuco dye reducing agents can be employed in the elements and compositions of the invention. The exact mechanism by which the color image is produced with the combination of described components is not fully understood. However, it is believed that the phenolic leuco dye reducing agent reacts with the silver salt of a long-chain fatty acid to produce a desired image in the imagewise exposed areas of the photothermographic element upon uniform heating of the exposed element. It is believed that the latent image silver produced upon imagewise exposure catalyzes the reaction between the phenolic leuco dye reducing agent and the silver salt of a long-chain fatty acid.

A "phenolic leuco dye reducing agent" as employed herein is accordingly defined to mean a phenolic leuco dye which is colorless with other components of the described element or composition before imagewise exposure and which provides a desired color image with the described components upon uniform heating after imagewise exposure. The described phenolic leuco dye reducing agent is believed to be oxidized imagewise in the exposed areas. An example of a phenolic leuco dye reducing agent as described herein is a phenolic compound containing a reduced azomethine linkage which can undergo chromogenic oxidation to produce an imine dye in the exposed areas. Another example of a phenolic leuco dye reducing agent as described herein is a phenolic compound containing a reduced hydrocarbon linkage which can undergo chromogenic oxidation to produce a methide dye in the exposed areas. Accordingly, the described phenolic leuco dye reducing agent is believed to require the capability of being oxidized imagewise.

Various tests can be employed for determining a useful phenolic leuco dye reducing agent in a photothermographic material according to the invention. One test for determining a useful phenolic leuco dye reducing agent is described in following Example 1. When the phenolic leuco dye reducing agent to be tested is employed in place of the phenolic dye reducing agent described in Example 1, the phenolic leuco dye reducing agent is considered useful if a color is observed in the photothermographic element upon imagewise exposure and overall heating as described in Example 1.

A useful class of phenolic leuco dye reducing agents as described herein is represented by the formula:

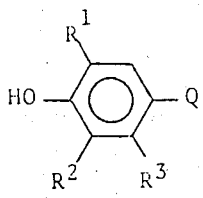

wherein $R^1$ is halo, especially bromo, chloro or iodo, alkyl containing 1 to 7 carbon atoms, such as methyl, ethyl, propyl or butyl, an aliphatic carbocyclic group containing 5 to 10 carbon atoms, such as cyclopentyl, cyclohexyl and cycloheptyl, alkoxy containing 1 to 5 carbon atoms, such as methoxy, ethoxy and propoxy, and amide represented by the formula:

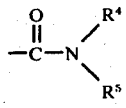

wherein $R^4$ and $R^5$ are individually hydrogen, alkyl containing 1 to 10 carbon atoms, such as methyl, ethyl, hexyl and octyl, preferably 1 to 4 carbon atoms and aryl containing 6 to 12 carbon atoms, such as phenyl and naphthyl;

$R^2$ is halo especially bromo, chloro or iodo, alkyl containing 1 to 7 carbon atoms, such as methyl, ethyl, propyl or butyl, an aliphatic carbocyclic group containing 5 to 10 carbon atoms, such as cyclopentyl, cyclohexyl and cycloheptyl, alkoxy containing 1 to 5 carbon atoms, such as methoxy, ethoxy and propoxy, and amide represented by the formula:

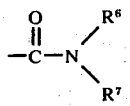

wherein $R^6$ and $R^7$ are individually hydrogen, alkyl containing 1 to 10 carbon atoms, such as methyl, ethyl, hexyl and octyl, and aryl containing 6 to 12 carbon atoms, such as phenyl and naphthyl; or $R^2$ with $R^3$ consists of atoms necessary to complete a naphthalenic ring, $R^3$ is hydrogen or with $R^2$ consists of atoms necessary to complete a naphthalenic ring, and Q is a group which enables the phenolic leuco dye reducing agent to be oxidizable to a quinone methide dye or azomethine dye.

For example, Q can be a group represented by the formula:

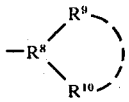

wherein $R^8$ is CH, N or together with $R^9$ and $R^{10}$ represents atoms necessary to complete a 1-H-imidazole nucleus, and wherein $R^9$ is hydrogen, alkyl containing 1 to 10 carbon atoms, such as methyl, ethyl, hexyl and octyl, preferably 1 to 4 carbon atoms, aryl containing 6 to 12 carbon atoms such as phenyl and naphthyl, or with $R^8$ and $R^{10}$ represents atoms necessary to complete a 1-H-imidazole nucleus, $R^{10}$ is alkyl containing 1 to 10 carbon atoms, such as methyl, ethyl, hexyl and octyl, preferably 1 to 4 carbon atoms, aryl containing 6 to 12 carbon atoms, such as phenyl and naphthyl, or with $R^8$ and $R^9$ represents atoms necessary to complete a 1-H-imidazole nucleus.

The described aryl groups for $R^9$ and $R^{10}$ are also intended to include substituents on the aryl groups which do not adversely affect the desired properties of the photothermographic materials of the invention, such as chlorine, bromine and iodine, hydroxy, nitro, alkoxy containing 1 to 3 carbon atoms and dialkylamino containing 2 to 8 carbon atoms.

Because the leuco form of the dye reducing agent is essentially colorless, it provides a means of producing an image when the leuco form is oxidized to the desired color.

A "color image" as employed herein is intended to mean an image which is other than colorless and includes images which can be observed within the visible portion of the spectrum. It also includes images which can be observed in other parts of the spectrum than the visible portion, such as the infrared portion of the spectrum. Typically, the colored image is a magenta, cyan or yellow image. The desired color of the image can be predetermined by selection of the desired phenolic leuco dye reducing agent.

One useful class of phenolic leuco dye reducing agents within the described formula is represented by the formula:

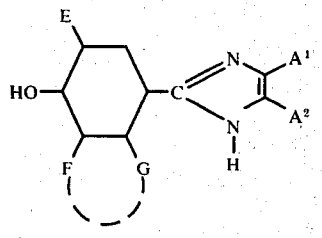

wherein

E and F are individually selected from the group consisting of halogen, such as chlorine, bromine or iodine, alkyl containing 1 to 7 carbon atoms, such as methyl, ethyl, propyl or butyl, aryl containing 6 to 12 carbon atoms, such as phenyl or tolyl, alkoxy containing 1 to 5 carbon atoms, such as methoxy, ethoxy or propoxy, and amides such as N,N-dimethylcarboximide, N,N-diethylcarboximide and N,N-dibutylcarboximide; and F can comprise the atoms necessary with G to complete a naphthalenic ring, G is hydrogen or with F comprises the atom necessary to complete a naphthalenic ring;

$A^1$ and $A^2$ are each aryl containing 6 to 12 carbon atoms, such as phenyl or naphthyl or alkyl containing 1 to 5 carbon atoms, such as methyl, ethyl, propyl, butyl or pentyl.

The substituent groups on the aryl nuclei of the described phenolic leuco dye reducing agents can contain substituent groups which do not adversely affect the desired properties of the photothermographic materials of the invention. For example, the described aryl groups can contain substituents such as alkoxy containing 1 to 3 carbon atoms, dialkylamino containing 2 to 8 carbon atoms, alkylamide containing 2 to 5 carbon atoms, chlorine, bromine and iodine, alkyl containing 1 to 4 carbon atoms, including methyl, ethyl, propyl and butyl which do not adversely effect the phenolic leuco dye reducing agent. Phenolic leuco dye reducing agent as employed herein is intended to include such substituent groups.

Examples of useful phenolic leuco dye reducing agents according to the invention are as follows:

2-(3,5-di-tert-butyl-4-hydroxyphenyl)-4,5-diphenylimidazole 2-(4-hydroxy-3,5-dimethoxy)-4,5-bis(p-methoxyphenyl) imidazole bis-(3,5-di-tert-butyl-4-hydroxyphenyl)phenylmethane The described phenolic leuco dye reducing agents can be prepared by methods known in the art. For example, one method of preparing phenolic dye reducing agents according to the invention is described in U.S. Pat. No. 3,297,710 of Silversmith, issued Jan. 10, 1967.

The preparation of 2-(3,5-di-tert-butyl-4-hydroxyphenyl)-4-(2,4,6-trimethyl-phenyl)-5-phenylimidazole is representative of the preparation of phenolic leuco dye reducing agents according to the invention. In this preparation 8.5 grams (0.0363 mole) of 3,5-di-tert-butyl-4-hydroxybenzaldehyde and 9.14 grams (0.0363 mole) of 2,4,6-trimethylbenzil are dissolved in 100 milliliters of acetic acid and 29 grams of ammonium acetate is added to the resulting composition. The mixture is heated to reflux under nitrogen for 3 hours. After cooling, the reaction mixture is poured into 800 milliliters of water. The precipitate which forms is filtered off and dissolved in ether. The ether solution is extracted with 5% sodium bicarbonate solution until neutral, then washed with water. The resulting ether solution is dried over anhydrous sodium sulfate, and the ether is then removed under reduced pressure. The resulting desired phenolic dye reducing agent is purified, such as by recrystallization from benzene-hexane, to provide a purified product having a melting point of 284°–286° C.

Another representative preparation is the preparation of 3,3′-dicarbomethoxy-4,4′-dihydroxy-5,5′-dimethyl-4″-dimethylaminotriphenylmethane. According to this preparation, 10 grams (0.023 mole) of 3,3′-dicarboxy-4,4′-dihydroxy-5,5′-dimethyl-4‴-dimethylaminotriphenylmethane is dissolved in 200 milliliters of methanol, and hydrogen chloride gas is added to the solution until a precipitate is formed. The resulting mixture is refluxed for 30 hours. To the resulting cooled solution is added 100 milliliters of water; then 25% sodium hydroxide solution is added until the resulting composition is neutral to litmus paper. The resulting solution is extracted with ether, the ether layer washed with 5% aqueous sodium hydroxide, then dilute hydrochloric acid is added until the composition is neutral. The ether layer is dried over anhydrous sodium sulfate and then the ether is removed under reduced pressure. The resulting crystals of the desired phenolic dye reducing agent can be purified such as by recrystallization from ethanol, then from acetonitrile to provide a purified white product having a melting point of 178°–179° C.

One embodiment of the invention is a photothermographic element for producing developed, color images comprising a support having coated thereon (a) photographic silver halide in association with (b) a silver salt of a long-chain fatty acid, (c) a phenolic leuco dye reducing agent for said silver salt of a long-chain fatty acid, and (d) a synthetic polymeric binder, said phenolic leuco dye reducing agent being oxidizable imagewise.

The photothermographic elements and compositions of the invention contain photographic silver halide. In the described photothermographic materials, it is believed that the latent image silver from the photographic silver halide acts as a catalyst for the reaction between the silver salt of a long-chain fatty acid and the described phenolic leuco dye reducing agent. The term "in association with" as employed herein regarding the described photosensitive silver halide is intended to mean that the location of the photosensitive silver halide in the photothermographic element or composition of the invention is such that will enable this catalytic action. A typical concentration range of photographic silver halide in the photothermographic elements and compositions of the invention is from about 0.005 to about 0.50 mole of photographic silver halide per mole of silver salt of a long-chain fatty acid in the described photothermographic element and composition. Examples of useful photographic silver halides are silver chloride, silver bromide, silver bromoiodide, silver chlorobromoiodide or mixtures thereof. The photographic silver halide is typically present with the other components of the described photothermographic element and composition in the form of an emulsion which is a dispersion of the photographic silver halide in a suitable binder. A gelatin binder is not desired because it can cause formation of a weak image. The photographic silver halide can be coarse or fine-grain, very fine-grain silver halide being especially useful. The composition containing the photographic silver halide can be prepared by any of the well-known procedures in the photographic art, such as single-jet emulsions, Lippmann emulsions, ammoniacal emulsions, thiocyanate or thioether ripened emulsions. Surface image photographic silver halide emulsions can be used if desired. If desired, mixtures of surface and internal image photographic silver halide emulsions can be used as described in U.S. Pat. No. 2,996,332 of Luckey et al., issued Apr. 15, 1961. Negative type emulsions can be used. The silver halide can be a regular grain silver halide such as described in Klein and Moisar, *Journal of Photographic Science*, Volume 12, No. 5, September-October (1964), pages 242–251.

The silver halide employed according to the invention can be unwashed or washed to remove soluble salts. In the latter case, the soluble salts can be removed by chill setting and leaching or an emulsion containing the silver halide can be coagulation washed.

The silver halide employed in the practice of the invention can be sensitized with chemical sensitizers such as with reducing agents; sulfur, selenium or tellurium compounds; gold, platinum or palladium compounds; or combinations of these. Suitable procedures for chemical sensitization are described, for example, in U.S. Pat. No. 1,623,499 of Shepard, issued Apr. 5, 1927; U.S. Pat. No. 2,399,083 of Waller et al., issued Apr. 23, 1946; U.S. Pat. No. 3,297,447 to McVeigh, issued Jan. 10, 1967 and U.S. Pat. No. 3,297,446 of Dunn, issued Jan. 10, 1967.

Photographic silver halide employed according to the invention can be protected against the production of fog and can be stabilized against loss of sensitivity during keeping. Useful antifoggants and stabilizers which can be used alone or in combination include, for example, thiazolium salts; azaindene; and mercury salts as described, for example, in U.S. Pat. No. 2,728,663 of Allen et al., issued Dec. 27, 1955; urazoles; sulfocatechols; oximes described, for example, in British Patent. No. 623,448; nitron; nitroindazoles; polyvalent metal salts described, for example, in U.S. Pat. No. 2,839,405 of Jones, issued June 17, 1958; platinum, palladium and gold salts described, for example, in U.S. Pat. No. 2,566,263 of Trivelli et al., issued Aug. 28, 1951 and U.S. Pat. No. 2,597,915 of Yutzy et al., issued May 27, 1952.

If desired, the photographic silver halide can be prepared in situ in the photothermographic element or composition according to the invention. The photographic silver halide can be prepared in the mixture of one or more of the other components of the described photothermographic element or composition rather than prepared separate from the described components and then admixed with them. Such a method is described, for example, in U.S. Pat. No. 3,457,075 of Morgan et al., issued July 22, 1969. For example, the photographic silver halide can be prepared on the silver salt of the long-chain fatty acid prior to admixture of the photographic silver halide and silver salt of a long-chain fatty acid to other components of the photothermographic materials as described. In this preparation, a halide salt can be added to a suspension of the silver salt of a long-chain fatty acid to form a desired photographic silver halide. A useful reaction medium includes water or other solvents which do not interfere with the desired reaction.

The described photothermographic elements and compositions comprise a silver salt of a long-chain fatty acid which is believed to be an oxidizing agent which reacts with the described phenolic leuco dye reducing agent. The silver salt of the long-chain fatty acid should be resistant to darkening under illumination to prevent undesired deterioration of a developed image. "Long chain" as employed herein is intended to mean a chain of carbon atoms containing at least 10 carbon atoms, typically 10 to 30 carbon atoms. An especially useful class of silver salts of long-chain fatty acids are those containing at least 20 carbon atoms. Compounds which are useful silver salts of long-chain fatty acids include silver behenate, silver stearate, silver oleate, silver laurate, silver hydroxy-stearate, silver caprate, silver myristate and silver palmitate.

Minor proportions of other useful carboxylic acid silver salt oxidizing agents can be present with the silver salts of the long-chain fatty acids. These need not be silver salts of long-chain fatty acids. These include, for example, silver benzoate, silver phthalate, silver acetate and silver acid phthalate and the like.

Silver salt oxidizing agents which are not silver salts of long-chain fatty acids can be employed in minor concentrations with the described silver salts of long-chain fatty acids if desired. Such compounds include, for example, silver phthalazinone, silver benzotriazole, and silver saccharin. Minor proportions of oxidizing agents which are not silver salts can be used with the silver salts of the long-chain fatty acids if desired such as zinc oxide, gold stearate, mercury behenate, gold behenate and the like.

It is typically useful to have a long-chain fatty acid present in the described photothermographic material to provide a desired image. For example, when silver behenate is employed as the long-chain fatty acid silver salt, it is typically desirable to have a minor concentration of behenic acid present to provide an improved image. A typical concentration of fatty acid is about 0.1 mole to about 0.9 mole of the fatty acid per mole of silver salt of long-chain fatty acids in the photothermographic element or composition.

A photothermographic element or composition as described can contain various synthetic polymeric binders alone or in combination as vehicles or binding agents and in various layers. Suitable materials are typically hydrophobic, but hydrophilic materials can be employed. They are transparent or translucent and include such naturally-occurring substances as cellulose derivatives and synthetic polymeric substances such as polyvinyl compounds which are compatible with the described components of the photothermographic elements and compositions of the invention. Other synthetic polymeric materials which can be employed include dispersed vinyl compounds such as in latex form and particularly those which increase dimensional stability of photographic materials. Effective polymers include water insoluble polymers of alkyl acrylates and methacrylates, acrylic acid, sulfoalkylacrylates or methacrylates, and those which have cross-linking sites which facilitate hardening or curing as well as those which have recurring sulfobetaine units as described in Canadian Patent No. 774,054. Useful high molecular weight materials and resins include poly(vinyl butyral), cellulose acetate butyrate, polymethylmethacrylate, ethyl cellulose, polystyrene, polyvinyl chloride, chlorinated rubber, polyisobutylene, butadiene-styrene copolymers, vinyl chloride-vinyl acetate copolymers, copolymers of vinyl acetate, vinyl chloride and maleic acid and poly(vinyl alcohol).

Other reducing agents which are not phenolic leuco dye reducing agents and which do not adversely affect the desired color image upon heating of the photothermographic material can be used in combination with the other described components of the photothermographic elements and compositions of the invention.

Other useful reducing agents include, for example, bis-beta-naphthol reducing agents as described in U.S. Pat. No. 3,751,249 of Hiller, issued Aug. 7, 1973 and sulfonamidophenol reducing agents as described in Belgian Patent No. 802,519 issued. Jan. 18, 1974. Combinations of the described reducing agents can be employed if desired.

It is desirable to employ a so-called development modifier, also known as a toning agent or known as an accelerator-toning agent or known as an activator-toning agent, in photothermographic elements and compositions according to the invention to obtain a desired image. The so-called development modifier is typically at a concentration of about 0.01 mole to about 0.40 mole of development modifier per mole of silver salt of long-chain fatty acid in the photothermographic material according to the invention. A typical useful so-called development modifier is a heterocyclic compound containing at least one nitrogen atom described as a toning agent in Belgian Patent No. 766,590 issued June 15, 1971. Typical development modifiers include, for example, phthalimide, N-hydroxyphthalimide, N-hydroxy-1,8-naphthalimide, N-potassium phthalimide, N-mercury phthalimide, succinimide and N-hydroxysuccinimide. Other so-called development modifiers which can be employed include phthalazinone, 2-acetyl-phthalazinone and the like. If desired, combinations of development modifiers can be employed in the described photothermographic materials.

It is believed that the described development modifiers provide increased development rate in the described photothermographic materials as well as provide improved image discrimination. In some cases the so-called development modifiers provide increased photographic speed as well as improved tone. The mechanism by which these results are provided is not fully understood.

The components of a photothermographic material according to the invention described herein can be coated on a wide variety of supports to provide a photothermographic element. Supports which are useful are those which can withstand the processing temperatures employed for providing a developed image. Typical supports include cellulose ester film, poly(vinyl acetal) film, polystyrene film, poly(ethylene terephthalate) film, polycarbonate film and related films or resinous materials as well as glass, paper, metal and the like. Typically, a flexible support is employed, especially a paper or film flexible support.

An especially useful embodiment of the invention is a photothermographic element comprising a support having coated thereon (a) photographic silver halide in association with (b) silver behenate, (c) a phenolic reducing agent for said silver behenate, (d) a development modifier comprising phthalazinone, succinimide, or N-hydroxy-1,8-naphthalimide, (e) a poly(vinyl butyral) binder for said layer, and (f) a phenolic leuco dye reducing agent for said silver behenate, said phenolic leuco dye reducing agent being oxidizable imagewise to a dye.

Another embodiment of the invention is a photothermographic composition, which is typically a dispersion, comprising (a) photographic silver halide in association with (b) a silver salt of a long-chain fatty acid, (c) a phenolic dye reducing agent for said silver salt of a long-chain fatty acid, and (d) a synthetic, polymeric binder.

A typical photothermographic composition within this embodiment comprises (a) photographic silver halide in association with (b) silver behenate, (c) a phenolic leuco dye reducing agent which is 2-(3,5-di-tert-butyl-4-hydroxyphenyl)-4,5-diphenylimidazole; 2-(4-hydroxy-3,5-dimethoxy)-4,5-bis(para-methoxyphenyl)imidazole; or bis-(3,5-di-tert-butyl-4-hydroxyphenyl)phenylmethane, and (d) a poly(vinyl butyral) binder.

The described components of a photothermographic material can be in a variety of locations in a photothermographic element according to the invention, such as in various layers of a photothermographic element, depending upon the particular components, the desired image, processing conditions and the like. For example, the described photographic silver halide can be in a layer separate from the other components of the photothermographic material. It is often desirable, however, to employ the described components in a single layer of a photothermographic element for convenience of coating.

Spectral sensitizing dyes can be used conveniently to confer additional sensitivity to photothermographic elements and compositions of the invention. For instance, additional spectral sensitization can be obtained by treating the photographic silver halide with a solution of a sensitizing dye in an organic solvent or the dye can be added in the form of a dispersion as described in British Patent No. 1,154,781. The spectral sensitizing dye can either be added to the photothermographic composition as a final step or at some earlier stage in preparation of the described composition.

Sensitizing dye useful in sensitizing silver halide compositions according to the invention are described, for example, in U.S. Pat. No. 2,526,632 of Brooker et al., issued Oct. 24, 1950; U.S. Pat. No. 2,503,776 of Sprague, issued Apr. 11, 1950 and U.S. Pat. No. 3,384,486 of Taber et al., issued May 21, 1968. Spectral sensitizers, which can be used, include the cyanines, merocyanines, complex (trinuclear or tetranuclear cyanines, holopolar cyanines, styryls, hemicyanines such as enamine, hemicyanines, oxonols and hemioxonols. Dyes of the cyanine classes can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl, and enamine groups that can be fused to carbocyclic or heterocyclic ring systems either unsubstituted or substituted with halogen, phenyl, alkyl, haloalkyl, cyano, or alkoxy groups. The dyes can be symmetrical or unsymmetrical and can contain alkyl, phenyl, enamine or heterocyclic substituents on the methine or polymethine chain.

The merocyanine dyes can contain the basic nuclei described, as well as acid nuclei such as thiohydantoins, rhodanines, oxazolidenediones, thiazolidenediones, barbituric acids, thiazolineones and malononitrile. These acid nuclei can be substituted with alkyl, alkylene, phenyl, carboxyalkyl, sulfoalkyl, hydroxyalkyl, alkoxyalkyl, alkylamine groups or heterocyclic nuclei.

Combinations of these dyes can be used, if desired. In addition, supersensitizing addenda which do not absorb visible light may be included such as, for instance, ascorbic acid derivatives, azaindenes, cadmium salts and organic sulfonic acid as described in U.S. Pat. No. 2,933,390 to McFall et al., issued Apr. 19, 1960 and U.S. Pat. No. 2,937,089 of Jones et al., issued May 17, 1960.

The sensitizing dyes and other addenda used in the photothermographic materials of the invention can be added from water solutions or useful organic solvents can be used. The compounds can be added using various procedures including those, for example, described in U.S. Pat. No. 2,912,343 of Collins et al., issued Nov. 10, 1959; U.S. Pat. No. 3,342,605 of McCrossen et al., issued Sept. 19, 1967; U.S. Pat. No. 2,996,287 of Audran, issued Aug. 15, 1961 and U.S. Pat. No. 3,425,835 of Johnson et al., issued Feb. 4, 1969.

Optimum useful concentrations of the described components of a photothermographic element and composition according to the invention will vary depending upon the particular photothermographic element and composition, desired image, processing conditions, particular components of the photothermographic element and composition, and the like. Typical useful concentrations of a photothermographic element are (a) about 0.1 mole to about 2.0 moles of photographic silver halide per mole of silver salt of a long-chain fatty acid, (b) about 0.5 mole to about 2.0 moles of a phenolic leuco dye reducing agent, as described, per mole of silver salt of a long-chain fatty acid and, if desired, (c) about 0.01 mole to about 0.40 mole of development modifier as described, per mole of silver salt of a long-chain fatty acid.

Another embodiment of the invention is a diffusion transfer, photothermographic element comprising a support having coated thereon (I) a layer comprising: (a) photographic silver halide in association with (b) a silver salt of a long-chain fatty acid, as described, (c) a phenolic leuco dye reducing agent, also as described, and (d) a synthetic polymeric binder and (II) an image receiving layer capable of receiving the phenolic dye provided by layer (I).

The diffusion transfer photothermographic element as described can comprise an image receiving layer (II) which is separable from the photothermographic element. For example, the image receiving layer (II) can be stripable from the photothermographic element after imagewise exposure and uniform heating of the photothermographic element. The image receiving layer (II) can comprise a dye mordant. A variety of mordants are useful according to the invention. Selection of a useful mordant will depend upon the particular dye image, processing conditions, particular components of the photothermographic element, desired image and the like. Useful mordants typically comprise a polymeric ammonium salt, such as those described in U.S. Pat. No. 3,709,690 of Cohen et al., issued Jan. 9, 1973. For example, a useful polymeric ammonium salt is represented by the formula:

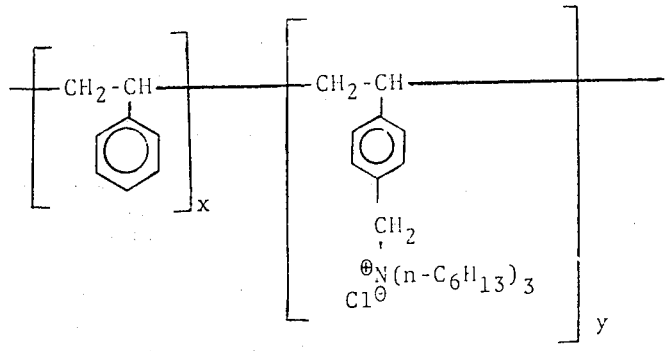

wherein $x$ and $y$ are selected to provide a ratio of the described units of about 1 to 1. A typical diffusion transfer photothermographic element has the described polymeric ammonium salt mixed with gelatin and coated on a polyester support. Transfer of a dye image from the photothermographic layer to this mordant with a solvent such as methanol, acetone or butyl acetate, can provide a color transparency. In another embodiment of the invention, the described mordant can be in gelatin and coated on a film support with an overcoat layer of titanium dioxide in gelatin. Transfer of dye from the photothermographic material can be achieved by wetting the titanium dioxide layer of the image receiver with a solvent, such as methanol, acetone or butyl acetate, followed by pressing the receiver against the photothermographic material containing the dye image. The dye image moves through the layer containing the titanium dioxide into the mordant layer. The resulting dye image can be viewed through the support because the titanium dioxide layer provides a so-called reflection base.

A mordant can be useful which has the capability of oxidizing the phenolic leuco dye reducing agent to a dye. Also, a mordant can be useful which has the capability of oxidizing a dye in its leuco form, that is in its colorless form, to a colored form. For example, a positive color image from a photothermographic material employing a diffusion transfer embodiment of the invention can be prepared by imagewise exposing a photothermographic element comprising a support having coated thereon (a) photographic silver halide in association with (b) a silver salt of a long-chain fatty acid, as described, and (c) a phenolic leuco dye reducing agent for said silver salt of a long-chain fatty acid, and (d) a synthetic polymeric binder, wherein the phenolic leuco dye reducing agent is oxidizable imagewise to a dye. After imagewise exposure, the photothermographic element is uniformly heated to the desired temperature to provide metallic silver plus dye image in the exposed areas. In the unexposed areas, the phenolic leuco dye reducing agent remains in its leuco form. Upon contacting the exposed and uniformly heated photothermographic layer with a mordant capable of oxidizing the leuco form of the dye to the desired colored form in the non-image areas, a selective transfer can be effected. Upon transfer of the dye in its leuco form, the mordant provides the necessary oxidation to provide a positive color image in the image receiver layer. The image receiver can then be separated, such as by delamination, from the photothermographic layer.

If desired, the silver remaining in the exposed and developed photothermographic element can then be bleached with a suitable bleaching agent. Bleaching of the silver present in the photothermographic element provides a negative dye image in the photothermographic element.

An "opacifying layer" as employed herein is intended to include layers which can reflect to a desired degree the radiation, such as visible light, which can be used to observe developed dye images in an image receiving layer in a diffusion transfer photothermographic element according to the invention. The opacifying layer can contain various agents, such as titanium dioxide, which provide the desired reflection. Titanium dioxide in an opacifying layer is described, for example, in U.S. Pat. No. 3,694,204 of Farney et al, issued Sept. 27, 1972.

Another embodiment of a diffusion transfer photothermographic element according to the invention is an integral diffusion transfer photothermographic element comprising in sequence (a) a transparent support having coated thereon a dye mordant layer, (b) an opacifying layer, such as a titanium dioxide opacifying layer, (c) a photothermographic layer comprising (i) photographic silver halide in association with (ii) a silver salt of a long-chain fatty acid, (iii) a phenolic leuco dye reducing agent as described, and (iv) a synthetic polymeric binder, and (d) a transparent overcoat layer.

An example of this embodiment is an integral diffusion transfer, photothermographic element comprising in sequence (a) a transparent support (b) a dye mordant layer comprising a polymeric quaternary ammonium salt, as described, (c) an opacifying titanium dioxide layer, (d) a photothermographic layer comprising (i) photographic silver halide in association with (ii) silver behenate, (iii) 2,6-dichloro-4-benzenesulfonamidophenol, (iv) 3,3′-dicarbomethoxy-4,4′-dihydroxy-5,5′-dimethyl-4′′-dimethylaminotriphenylmethane, (v) N-hydroxy-1,8-naphthalimide as a development modifier and (vi) a poly(vinyl butyral) binder, and (e) a transparent overcoat layer.

After imagewise exposing and then uniformly heating the described integral diffusion transfer photothermographic element, the resulting element can be treated with a solvent, such as methanol, acetone or butyl acetate, which can selectively transfer the unoxidized dye to the mordant layer through the opacifying layer while leaving the oxidized phenolic leuco dye reducing agent from the exposed areas in the photothermographic layer. The mordant layer can comprise an oxidizing mordant which can react with the transferred leuco dye reducing agent to provide a desired color image. With a transparent support, the resulting dye image in the image receiver layer can be viewed through the transparent support. Bleaching and fixing of the silver in the exposed areas of the photothermographic layer can provide an element having a positive dye image in the receiver layer and a negative dye image in the photothermographic layer.

A variety of exposure means is useful for providing a latent image in a photothermographic material as described according to the invention. A latent image is typically provided by imagewise exposure to electromagnetic radiation which includes visible light. A latent image can also be provided by imagewise exposure with, for instance, ultraviolet radiation, infrared radiation, a laser, electrical energy and the like. The exposure should be sufficient to provide a developable latent image in the described photothermographic material. Exposure above that which is necessary to provide a latent image can be employed, if desired.

After imagewise exposure of the photothermographic element of the invention, a dye image can be developed in the photothermographic material by uniformly heating the photothermographic layer to moderately elevated temperatures, such as a temperature within the range of from about 80° C. to about 250° to C. The photothermographic element is heated within the described range for a time sufficient to provide a color image, typically for about 0.5 second to about 60 seconds. By increasing or decreasing the length of time of heating, a higher or lower temperature within the described range can be employed depending upon the desired image, the particular components of the photothermographic element, and the like. A developed image is typically produced within several seconds at a processing temperature of about 110° to about 165° C.

Any suitable means can be used for providing the desired processing temperature range. The heating means can be a simple hot plate, iron, roller or the like.

Processing is usually carried on under ambient conditions of pressure and humidity. Conditions outside normal atmospheric pressure and humidity can be employed, if desired.

Photothermographic elements according to the invention can contain photographic speed-increasing compounds, hardeners, antistatic layers, plasticizers and lubricants, coating aids, brighteners, spectral sensitizing dyes, absorbing and filtering dyes, each as described in the *Product Licensing Index*, Volume 92, December, 1971, publication 9232, pages 107–110 and U.S. Pat. No. 3,761,270 of deMauriac et al., issued Sept. 25, 1970.

The photothermographic compositions and other compositions according to the invention can be coated on a suitable support by various coating procedures including dip coating, airknife coating, curtain coating or extrusion coating using hoppers such as described in U.S. Pat. No. 2,681,284 issued June 15, 1954. If desired, two or more layers can be coated simultaneously such as described in U.S. Pat. No. 2,761,791 of Russell, issued Sept. 4, 1956 and British Patent No. 837,095.

The following examples are included for a further understanding of the invention.

EXAMPLE 1

A dispersion is prepared by ball-milling together the following compounds for 72 hours:

| | |
|---|---|
| silver behenate | 8.0 g |
| behenic acid | 6.4 g |
| poly(vinyl butyral) | 3.0 g |
| methanol-acetone-toluene (1:1:1 parts by volume) | 100 ml |

After ball-milling this dispersion, it is rinsed in a light-tight jar with 40 ml of a mixture of acetone and toluene (1:1 parts by volume) and stirred with a magnetic stirring bar. To this stirred solution is added a solution of 150 mg of lithium bromide in 20 ml of methanol. The resulting dispersion is stirred for another hour.

Three ml of the resulting dispersion is added to seven ml of a solution of 20.8 mg of 4-phenylazo-1-napthol dissolved in a 2.5 percent by weight solution of poly(vinyl butyral) in 2-butanone. The resulting mixture is coated on a polyester film support of a 6 mil wet thickness at a temperature of 35° C. The resulting photothermographic material is permitted to dry and then cut into separate strips.

A strip of the photothermographic element is imagewise exposed for 5 seconds to tungsten light at 230-foot candles at the surface of the photothermographic element. The exposed photothermographic element is then uniformly heated by contacting it with a heated metal plate at a temperature of 120° C. for 7 seconds. The resulting photothermographic element is rinsed with methanol to remove unused reducing agent. This provides a red-dye image in the photothermographic element having excellent discrimination on a light buff background.

EXAMPLE 2

The following components are combined in the order indicated and ball-milled for 72 hours:

| | |
|---|---|
| silver behenate | 50.0 g |
| behenic acid | 32.0 g |
| poly(vinyl butyral) | 15.0 g |
| phthalimide | 8.5 g |
| acetone-toluene (1:1 parts by volume) | 500.0 ml |

The composition is ball-milled for 72 hours. Then 75.0 ml of an acetone solution containing 1% by weight lithium bromide is added to the composition. The composition is then stirred for 24 hours and coated on a paper support at a concentration of 0.008 mole of total silver per square meter of support.

A phenolic leuco dye reducing agent which is 2-(3,5-ditertiary-butyl-4-hydroxyphenyl)-4,5-diphenylimidazole is mixed with ethanol to provide a solution containing 10 grams of the phenolic leuco dye reducing agent per liter of ethanol. This solution is overcoated on the described photothermographic paper at the rate of 3.6 ml per 929 square decimeters of support. The resulting photothermographic element is imagewise exposed to tungsten light and then uniformly heated by contacting the photothermographic element on a heated metal block at 135° C. for 7 seconds. A green image having excellent discrimination on a white background is produced.

EXAMPLE 3

Three ml of a dispersion of silver behenate as described in Example 1 is added to a stirred solution of 71.0 mg. of the phenolic leuco dye reducing agent of Example 2, 16.1 mg. of 1-(2H)phthalazinone and 80 mg. of pentachlorophenol dissolved in 7 ml of a 2.5% poly(vinyl butyral) in acetone-toluene (1:1 parts by volume). The resulting composition is coated on a polyethylene coated paper support at 6 mil wet thickness. The resulting layer is dried to provide a photothermographic element. The photothermographic element is imagewise exposed to tungsten light to provide a latent image and then uniformly heated by contacting the element with a metal block at 135° C. for 12 seconds. The resulting photothermographic element exhibits a dense black image on a pale yellow background. The developed image, to reflected white light, provides a maximum density of 1.68 and a minimum density of 0.36.

A part of the photothermographic layer on the support is removed by swabbing the photothermographic element with a cleansing tissue moistened with ethanol. Removal of the emulsion layer reveals a yellow dye image embedded in the polyethylene coated support. The resulting yellow dye image is bright yellow on a white background. The yellow dye image, to reflected blue light, provides a maximum density of 1.04 and a minimum density of 0.10.

EXAMPLE 4

A photothermographic element is prepared by coating onto a polyethylene coated paper support, a mixture of 3 ml of the dispersion described in Example 1 containing silver behenate, 12.2 mg of 1-(2H)phthalazinone and 72.2 mg of the phenolic leuco dye reducing agent which is 2-(4-hydroxy-3,5-dimethoxy)-4,5-bis(para-methoxyphenyl)imidazole dissolved in 7 ml of 2.5% poly(vinyl butyral) in methanol-toluene (1:1 parts by volume). The described mixture is coated on the paper support at 6 mil thickness. The resulting photothermographic coating is dried.

The photothermographic element is cut into strips. One of the strips is imagewise exposed to tungsten light and then uniformly heated by contacting the photothermographic element on a metal block at 100° C. for 30 seconds. A developed magenta image with a pale pink background is provided. The photothermographic layer is then removed from the described support by swabbing the photothermographic layer with a tissue moistened with ethanol as described in Example 3. This reveals a magenta dye image on a white background in the polyethylene on the paper support.

EXAMPLE 5

A photothermographic composition is prepared by mixing 3 ml of the silver behenate dispersion described in Example 1 with 84.7 mg of a phenolic leuco dye reducing agent which is bis-(3,5-di-tertiary-butyl-4-hydroxyphenyl)phenylmethane and 12.2 mg of 1-(2H)phthalazinone dissolved in 7 ml of 2.5% by weight poly(vinyl butyral) in acetone-toluene (1:1 parts by volume). The resulting photothermographic composition is coated on a polyethylene coated paper support at a 6 mil wet thickness. The coating is permitted to dry. The resulting photothermographic element is imagewise exposed to tungsten light and then uniformly heated by contacting the element with a metal block at 150° C. for 12 seconds. A brown, developed image on a pale yellow background is produced.

An image receiver is prepared by overcoating a paper support with a 6 mil wet coating thickness of 2.5% by weight poly(vinyl butyral) in acetone-toluene (1:1 parts by volume). The receiver is permitted to dry. The receiver is then moistened with methanol and laminated to the processed photothermographic element. The image receiver is permitted to remain in contact with the photothermographic element for 30 seconds at a temperature of about 20° C. The image receiver is then removed from the photothermographic element. A yellow dye image is observed to have been transferred to the image receiver from the photothermographic element.

Another image receiver is prepared by overcoating a paper support at a wet coating thickness of 6 mil with cetyltrimethylammonium bromide and sodium methoxide in 2.5% by weight poly(vinyl butyral). The receiver is permitted to dry. The resulting image receiver is moistened with methanol and a second processed photothermographic element as described above is contacted with the resulting receiver. The receiver is permitted to remain in contact with the processed photothermographic element for 30 seconds at a temperature of about 20° C. The receiver is then removed from the photothermographic element and a cyan dye image is observed to have been transferred from the photothermographic element to the receiver layer.

The hue of the cyan image observed when the image from the photothermographic layer is transferred to the mordanting receiver containing sodium methoxide and cetyltrimethylammonium bromide is the same as that observed when the phenolic dye is made basic in a solution of sodium methoxide in methanol. The color of the phenolic dye shifts from yellow to cyan in such a solution.

EXAMPLE 6

As illustrated in the following photothermographic element, a dye image can be enhanced by employing an auxiliary reducing agent and a development modifier in the photothermographic material.

A series of photothermographic elements A through D is prepared. In each case the level of silver ion (3 ml of silver behenate dispersion as described in Example 1) and the phenolic leuco dye reducing agent (71.0 mg of the phenolic leuco dye reducing agent of Example 2) is kept constant. The photothermographic material contains 2,6-dichloro-4-benzenesulfonamidophenol as an auxiliary reducing agent and N-hydroxy-1,8-naphthalimide as a development modifier. The concentration of these compounds is listed in following Table I. A photothermographic element is prepared with these changes as described in Example 1. The photothermographic element is imagewise exposed to tungsten light as described in Example 1 and then uniformly heated by contacting the element with a heated metal block for 10 seconds at 100°C. The image discrimination (maximum density compared to minimum density) as well as the dye density of the resulting developed image after removal of the photothermographic layer with ethanol (dye maximum density compared to dye minimum density) is given in following Table I.

TABLE I

| Element | mg. of auxiliary reducing agent | mg. of development modifier | Silver image Dmax/Dmin | Dye Image: Dye Dmax/ Dye Dmin |
|---|---|---|---|---|
| A | 53.2 | 3.0 | 1.47/0.26 | 0.72/0.08 |
| B | 0 | 3.0 | 1.08/0.10 | 0.22/0.10 |
| C | 0 | 0 | 0.06/0.06 | no dye |
| D | 0.167 | 0 | 0.20/0.06 | no dye |

The use of 2,6-dichloro-4-benzenesulfonamidophenol with N-hydroxy-1,8-naphthalimide in the described photothermographic material provides shortened uniform heating time and the temperature needed for desired dye formation is lowered compared to a photothermographic material as described in Element C which does not contain the described auxiliary reducing agent and development modifier.

EXAMPLE 7

A dispersion is prepared by ball-milling together for 72 hours the following compounds:

| | |
|---|---|
| silver behenate | 33.6 g |
| behenic acid | 25.4 g |
| poly(vinyl butyral) | 12.0 g |
| toluene-methanol (1:1 parts by volume) | 400 ml |

After ball-milling, the composition is diluted with another 275 milliliters of the described solvent mixture. Three ml of the resulting dispersion is then added to 6 ml of a 2.5% by weight solution of poly(vinyl butyral) in 1:1 parts by volume of methanol:toluene in which is dissolved 3.0 mg (0.014 millimole) of N-hydroxy-1,8-naphthalimide and 77.9 mg (0.167 millimole) of 2-(3,5-di-tertiary-butyl-4-hydroxyphenyl)-4-(2,4,6-trimethylphenyl)-5-phenylimidazole. To this stirred mixture is added 1 ml of an emulsion comprising an acetone dispersion of silver bromoiodide (6% iodide) containing 0.370 millimole of silver per milliliter of dispersion, peptized with 50 g of poly(vinyl butyral) per mole of silver. The resulting photothermographic composition is coated on polyethylene paper support at 6 ml wet thickness. After drying, a strip of the resulting photothermographic element is imagewise exposed to tungsten light and then uniformly heated by contacting the element with a heated metal block for 4 seconds at 125° C.

The processed element provides a brown developed image on a buff background. The developed image has a maximum reflection density to white light of 1.76 and a minimum density of 0.70.

A portion of the photothermographic coating on the support after processing is removed by swabbing with a cleansing tissue moistened with ethanol. This reveals a yellow dye image embedded in the polyethylene coating having a white background. The yellow dye image has a maximum reflection density to blue light of 1.04 and a minimum density of 0.30.

EXAMPLE 8

To a solution of 77.51 mg (0.167 millimole) of 3,3'-dicarbomethoxy-4,4'-dihydroxy-5,5'-dimethyl-4''-dimethylaminotriphenylmethane, 53.2 milligrams (0.167 millimole) of 2,6-dichloro-4-benzenesulfonamidophenol, 3.0 milligrams (0.014 millimole) of N-hydroxy-1,8-naphthalimide and 632 milligrams (2.11 millimoles) methylstearate dissolved in 2.5% by weight poly(vinyl butyral) in 1:1 parts by volume acetone:toluene is added 3 milliliters of a dispersion of silver behenate and 1 milliliter of the silver bromoiodide emulsion, both as described in Example 7. This photothermographic composition is coated at 6 mils wet thickness on an image receiver.

The image receiver is prepared by coating a transparent polyethylene film support with a polymeric quaternary ammonium salt which is a dye mordant represented by the formula:

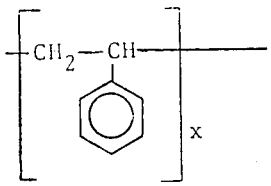

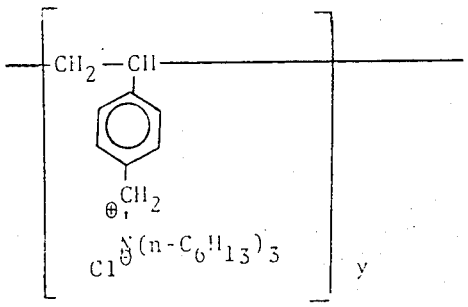

wherein $x$ and $y$ are selected to provide a ratio of the described units of about 1 to 1 in a gelatin binder. The resulting polymeric quaternary salt layer is overcoated with a titanium dioxide layer which provides an opacifying layer. The concentration of dye mordant is about 200 mg of dye mordant per 929 square centimeters of support. The titanium dioxide is coated at a concentration of 2,000 mg of titanium dioxide per 929 square centimeters of support.

The resulting integral diffusion transfer photothermographic element is exposed to tungsten light imagewise for 0.5 second and then uniformly heated by contacting the mordant layer side of the photothermographic element with a heated metal block for 120 seconds at 90° C. A dye image is produced in the photothermographic layer and transferred through the titanium dioxide layer into the dye mordant layer. The maximum dye density in the image areas of the image receiver to green reflected light is 0.50 and the minimum density is 0.25.

The invention has been described in detail with particular reference to preferred embodiments thereof, but it will be understood that variations and modifications can be effected within the spirit and scope of the invention.

What is claimed is:

1. A photothermographic element for producing developed, color images consisting essentially of a support having coated thereon a. photographic silver halide in association with b. a silver salt of a long-chain fatty acid containing 10 to 30 carbon atoms, c. a phenolic leuco dye reducing agent for said silver salt of a long-chain fatty acid, and d. a synthetic polymeric binder, said leuco dye reducing agent being oxidizable imagewise.

2. A photothermographic element as in claim 1 wherein said phenolic leuco dye reducing agent is a compound represented by the formula:

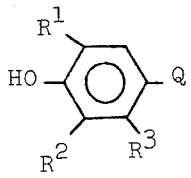

wherein $R^1$ is halo, alkyl containing 1 to 7 carbon atoms, an aliphatic carbocyclic group containing 5 to 10 carbon atoms, alkoxy containing 1 to 5 carbon atoms, and amide represented by the formula:

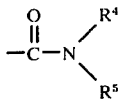

wherein $R^4$ and $R^5$ are individually hydrogen, alkyl containing 1 to 10 carbon atoms, or aryl containing 6 to 12 carbon atoms, $R^2$ is halo, alkyl containing 1 to 7 carbon atoms, an aliphatic carbocyclic group containing 5 to 10 carbon atoms, alkoxy containing 1 to 5 carbon atoms, alkoxycarbonyl containing 2 to 6 carbon atoms and amide represented by the formula:

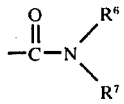

wherein $R^6$ and $R^7$ are individually hydrogen, alkyl containing 1 to 10 carbon atoms, aryl containing 6 to 12 carbon atoms; or $R^2$ with $R^3$ consists of atoms necessary to complete a naphthalenic ring, $R^3$ is hydrogen or with $R^2$ consists of atoms necessary to complete a naphthalenic ring, and Q is a group which enables the phenolic dye reducing agent to be oxidizable to a quinone methide dye or azomethine dye.

3. A photothermographic element as in claim 1 wherein said phenolic leuco dye reducing agent is 2-(3,5-di-tert-butyl-4-hydroxyphenyl)-4,5-diphenylimidazole.

4. A photothermographic element as in claim 1 wherein said phenolic leuco dye reducing agent is 2-(4-hydroxy-3,5-dimethoxy)-4,5-bis(p-methoxyphenyl-)imidazole.

5. A photothermographic element as in claim 1 wherein said phenolic leuco dye reducing agent is bis-(3,5-di-tert-butyl-4-hydroxyphenyl)phenylmethane.

6. A photothermographic element as in claim 1 also comprising a development modifier.

7. A photothermographic element consisting essentially of a support having coated thereon a. photographic silver halide in association with b. silver behenate, c. a phenolic reducing agent for said silver behenate, d. a development modifier comprising phthalazinone, succinimide, or N-hydroxy-1,8-naphthalimide, e. a poly(vinyl butyral) binder, and f. a phenolic leuco dye reducing agent for said silver behenate, said dye reducing agent being oxidizable imagewise.

8. A photothermographic composition consisting essentially of a. photographic silver halide in association with b. a silver salt of a long-chain fatty acid containing 10 to 30 carbon atoms, c. a phenolic leuco dye reducing agent for said silver salt of a long-chain fatty acid, and d. a synthetic, polymeric binder.

9. A photothermographic composition comprising a. photographic silver halide in association with b. silver behenate, c. 2-(3,5-di-tert-butyl-4-hydroxyphenyl)-4,5-diphenylimidazole, and d. a poly(vinyl butyral) binder.

10. A photothermographic composition comprising a. photographic silver halide in association with b. silver behenate, c. 2-(4-hydroxy-3,5-dimethoxy)-4,5-bis(p-methoxyphenyl)imidazole, and d. a poly(vinyl buryral) binder.

11. A photothermographic composition comprising a. photographic silver halide in association with b. silver behenate, c. bis-(3,5-di-tert-butyl-4-hydroxyphenyl)phenylmethane, and d. a poly(vinyl butyral) binder.

12. A photothermographic composition as in claim 8 also comprising a development modifier.

* * * * *